US005233391A

United States Patent [19]

Ohnishi et al.

[11] Patent Number: 5,233,391

[45] Date of Patent: Aug. 3, 1993

[54] IMAGE ADJUSTING APPARATUS HAVING A CONTROLLED THE VOLTAGE APPLIED TO THE LIGHT SOURCE THEREOF

[75] Inventors: Kazuyuki Ohnishi, Nara; Yasutaka Maeda, Ikoma; Hiroshi Kawamoto, Nara, all of Japan

[73] Assignee: Sharp Kabushiki Kaisha, Osaka, Japan

[21] Appl. No.: 889,727

[22] Filed: May 28, 1992

[30] Foreign Application Priority Data

Jun. 10, 1991 [JP] Japan ..... 3-137810

[51] Int. Cl.[5] ..... G03G 21/00

[52] U.S. Cl. ..... 355/246; 355/208

[58] Field of Search ..... 355/203, 204, 208, 246, 355/245, 210, 228, 229

[56] References Cited

U.S. PATENT DOCUMENTS 4,647,184 3/1987 Russell et al. ..... 355/208
4,829,336 5/1989 Champion et al. ..... 355/246
5,103,260 4/1992 Tompkins et al. ..... 355/208
5,107,301 4/1992 Yamauchi ..... 355/208

FOREIGN PATENT DOCUMENTS 58-23066 2/1983 Japan .

*Primary Examiner*—A. T. Grimley
*Assistant Examiner*—Sandra L. Brasé
*Attorney, Agent, or Firm*—David G. Conlin; Robert F. O'Connell

[57] ABSTRACT

An image adjusting apparatus being provided in a copying machine capable of performing a copy of an original by using a photosensitive body in two or more copying modes, includes a unit for sensing a toner density of an image formed on the photosensitive body, a unit for deriving a function in accordance with each of the two or more copying modes if a control voltage influencing the toner density is changed, and a unit for setting the control voltage to be a voltage value obtained based on a predetermined reference toner density and the function derived by the deriving unit. The function stands for a relation between the changed control voltage and the toner density sensed by the sensing unit.

7 Claims, 10 Drawing Sheets

IMAGE ADJUSTING APPARATUS HAVING A CONTROLLED THE VOLTAGE APPLIED TO THE LIGHT SOURCE THEREOF

BACKGROUND OF THE INVENTION

1. Field of the Invention

The present invention relates to an image adjusting apparatus which is capable of automatically adjusting a toner density on a copied image.

2. Description of the Related Art

The present inventors know an image forming apparatus such as a copying machine which includes an image adjusting apparatus. Such as the copying machine is, in general, arranged to have a defined toner density of a copied image. That is, the toner density is pre-defined in light of some factors of the components included in the copying machine, such as an exposing voltage of a copy lamp, a charging voltage of a charger and a developing bias voltage of a developer. For automatically adjusting the toner density of the copied image, therefore, it is possible to take the steps of measuring a toner density and an electric potential on a photosensitive body, deriving optimum voltage values based on the measured values, and controlling at least one of the above-mentioned voltages by referring to the corresponding optimum voltage.

In order to measure the toner density on the photosensitive body and derive a reference voltage of an exposing voltage of a copy lamp based on the measured toner density, for example, the forgoing image adjusting apparatus is arranged to measure a toner density of a sample by changing an exposing voltage, to obtain a relation between the exposing voltage and the toner density as a certain function such as a polygonal line approximation or a least square method and to derive a reference voltage so that the toner density may reach a predetermined value in light of the obtained relation. In this case, the relation between the exposing voltage and the toner density approximates to a linear function if the least square method is used.

However, in case of deriving the reference exposing voltage of the copy lamp base on the measured toner density on the photosensitive body for example, the relation approximating to the linear function such as the polygonal line may make the reference voltage erroneous if one of the samples has a too much dispersion. This results in disadvantageously disabling to adjust the toner density of the copied image accurately.

Further, if the forgoing image adjusting apparatus employs the least square method, the relation between the exposing voltage and the toner density is obtained as one kind of function. Hence, if the copying machine may provide two or more copying modes such as a photo mode for copying a photograph and a graphic mode for copying characters or graphics, the same function may apply to obtention of a reference voltage at any mode in such the image adjusting apparatus. This results in disadvantageously disabling to accurately adjust the toner density on the copied result at each copying mode.

SUMMARY OF THE INVENTION

It is therefore an object of the present invention to provide an image adjusting apparatus which is capable of automatically and accurately adjusting a toner density on a copied image for two or more copying modes.

In carrying out the object, according to a first aspect of the present invention, an image adjusting apparatus being provided in a copying machine capable of performing a copy of an original by using a photosensitive body in two or more copying modes, includes:

a unit for sensing a toner density of an image formed on the photosensitive body;

a unit for deriving a function in accordance with each of the two or more copying modes if a control voltage influencing the toner density is changed, the function standing for a relation between the changed control voltage and the toner density sensed by the sensing unit; and a unit for setting the control voltage to be a voltage value obtained based on a predetermined reference toner density and the function derived by the deriving unit.

According to a second aspect of the present invention, an image adjusting apparatus being provided in a copying machine capable of performing a copy of an original by using a photosensitive body in two or more copying modes, includes:

a unit for sensing a toner density of an image formed on the photosensitive body;

a unit for deriving a function of the second or more order as the same functional type independently of each of the two or more copying modes if a control voltage influencing the toner density is changed, the function standing for a relation between the changed control voltage and the toner density sensed by the sensing unit; and a unit for setting the control voltage to be a voltage value obtained based on a predetermined reference toner density and the function derived by the deriving unit.

In the operation of the first aspect of the invention, when changing the control voltage influencing the toner density of the image formed on the photosensitive body, the deriving unit serves to derive a function in accordance with each of the two or more copying modes. The function stands for a relation between the changed control voltage and the toner density sensed by the sensing unit. The setting unit serves to set the control voltage to be a reference voltage value obtained based on a cross point between the predetermined reference toner density value and the function derived by the deriving unit. The control voltage is set as the obtained reference voltage. As such, the reference voltage for adjusting the toner density is calculated based on the function in accordance with each of the copying modes. This makes it possible to automatically and accurately adjust the toner density of the copied image in accordance with each of the two or more copying modes.

In the operation of the second aspect of the second invention, when changing the control voltage influencing the toner density of the image formed on the photosensitive body, the deriving unit serves to derive a function of the second or more order as the same functional type independently of the two or more copying modes. The function stands for a relation between the changed control voltage and the toner density sensed by the sensing unit. Then, the setting unit serves to set the control voltage to be a reference voltage value obtained based on a cross point between the predetermined reference toner density value and the function derived by the deriving unit. The control voltage is set as the obtained reference voltage. As such, the reference voltage for adjusting the toner density is calculated based on the function of the second or more order having the same functional type independently of the two or more copying modes. This makes it possible to automatically and accurately adjust the toner density of the copied image for the two or more copying modes.

Further objects and advantages of the present invention will be apparent from the following description of the preferred embodiments of the invention as illustrated in the accompanying drawings.

DESCRIPTION OF THE PREFERRED EMBODIMENTS

Herein, an embodiment of the present invention will be described with reference to the drawings.

Figure 1:
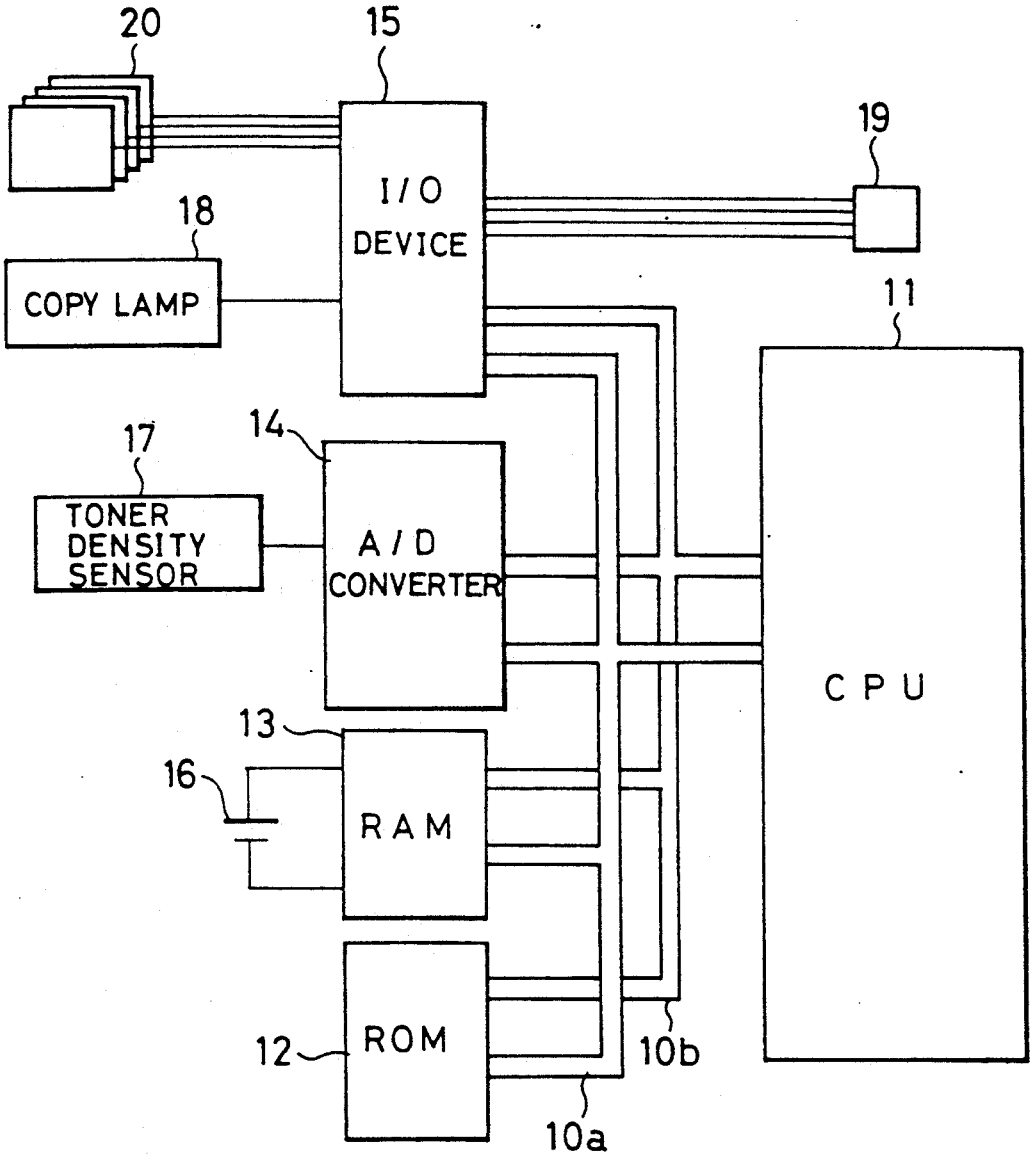
FIG. 1 is a block diagram showing embodiment of an arrangement of an image adjusting apparatus according to a first aspect of the present invention.

FIG. 1 is a block diagram showing an arrangement of an image adjusting apparatus according to a first aspect of the present invention.

As shown in FIG. 1, the image adjusting apparatus of this embodiment includes a CPU (Central Processing Unit) 11, a ROM (Read Only Memory) 12, a RAM (Random Access Memory) 13, an A/D (Analog/Digital) converter 14, and an I/O (Input/Output) device 15.

Figure 2:
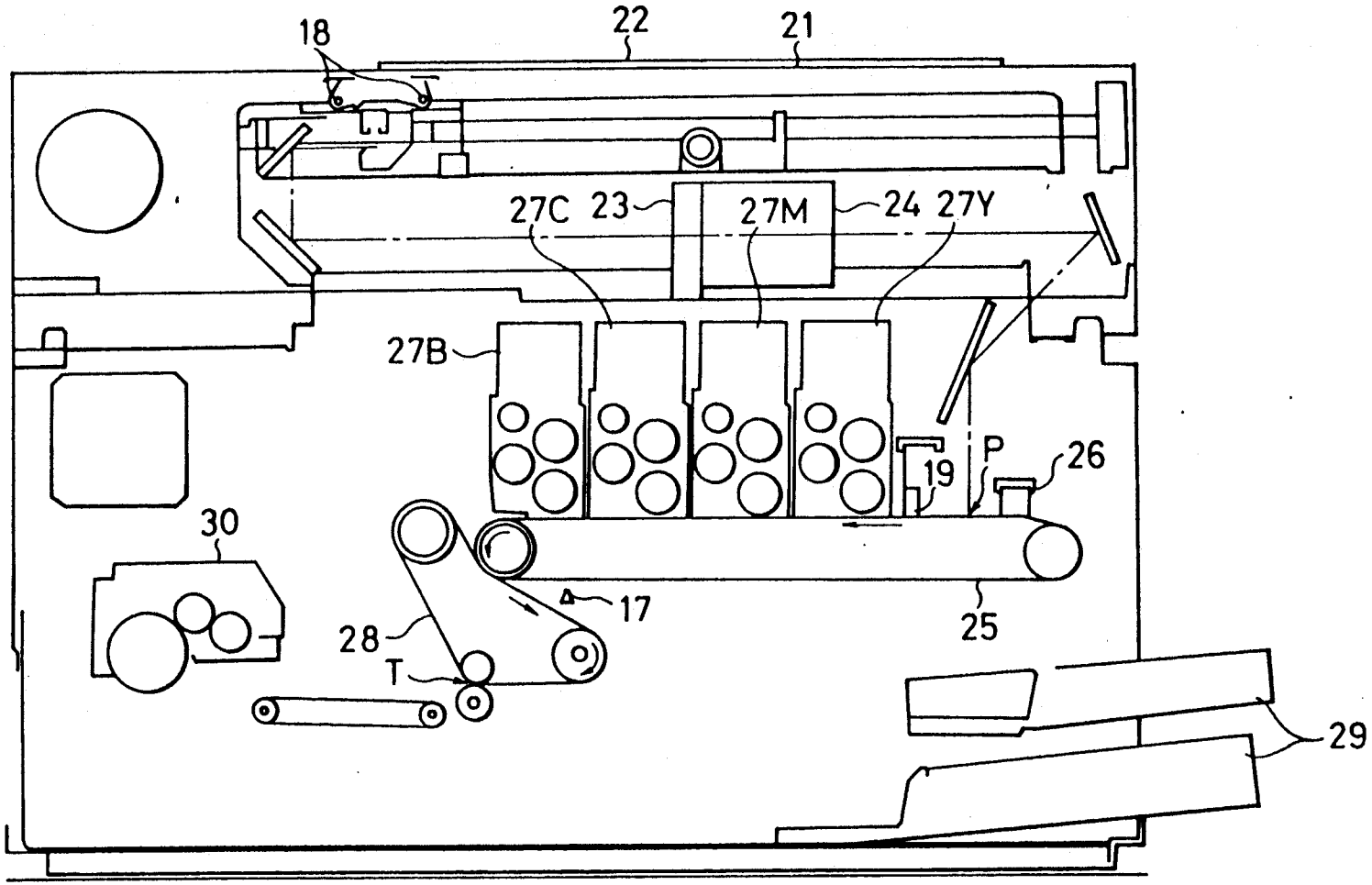
FIG. 2 is a sectional view showing an arrangement of a color copying machine providing the image adjusting apparatus shown in FIG. 1.

The CPU 11 operates to control a color copying machine (see FIG. 2). Concretely, the CPU 11 calculates a reference voltage on which a toner density of a copied image is automatically adjusted. The CPU 11 is connected to the ROM 12, the RAM 13, the A/D converter 14 and the I/O device 15, respectively, through an address bus 10*a* and a data bus 10*b*.

The ROM 12 pre-stores a program under which the color copying machine is controlled.

The RAM 13 has two areas, that is, a working area when the program is executed and a storage area for storing a reference voltage for automatically adjusting the toner density. The RAM 13 is backed up by a battery 16.

The A/D converter 14 is connected to a toner density sensor 17 for sensing a toner density of a copied image. The CPU 11 can read an output voltage of the toner density sensor 17 through the A/D converter 14.

The I/O device 15 is connected to a copy lamp 18 for lighting an original, a blank lamp 19 which allows a predetermined area on the photosensitive body to be used as an image copying area or a toner density sensing area, loads such as a copying motor and a solenoid, and various sensors 20. It means that the I/O device 15 is provided for controlling the loads applied on the CPU 11.

The copy lamp 18 is lit by an A. C. (Alternating Current) power source. An exposing voltage applied to the copy lamp 18 is controlled depending on the voltage-applying time according to the A. C. wave. The reference voltage of the copy lamp 18 in copying an image is defined on an adjusting value stored in the RAM 13.

The blank lamp 19 is arranged to have a plurality of light-emitting diodes (LEDs) arranged as blocks. Each block is oriented toward the main scan direction. In copying the image and sensing the tone density, the predetermined blocks of LEDs are lit on and the other blocks of LEDs are lit off.

The CPU 11 reads a sensing signal from the toner density sensor 17 and calculates the reference voltage of the copy lamp 18 by lighting off the copy lamp 18 and the LEDs of the toner density sensing area contained in the blank lamp 19.

Next, the description will be directed to the arrangement of a color copying machine providing the image adjusting apparatus described above.

FIG. 2 is a sectional view showing an arrangement of a color copying machine providing the image adjusting apparatus shown in FIG. 1.

As shown in FIG. 2, the color copying machine containing the image adjusting apparatus of this embodiment is constructed to have the copy lamp 18, the blank lamp 19, an original platform 21, an optical filter 23, an optical system 24, a photosensitive body (PC belt) 25, a high-pressure unit 26, developing units 27Y, 27M, 27C and 27B for using toners of yellow (Y), magenta (M), cyan (C) and black (B) respectively, a transfer medium (TX belt) 28, paper cassettes 29, and a fixer 30.

In the above construction, an original 22 placed on the original platform 21 is lit by the copy lamp 18. Herein, the term "original" means a material to be copied such as text, graphics, and pictures. The light reflected from the original 22 is decomposed into three original colors of red (R), green (G) and blue (B). Those color lights are guided to an exposing location P of the PC belt 25 through the optical system 24 which includes one or more lenses. An electrostatic latent image of each color is formed on the PC belt 25.

The PC belt 25 is rotated counterclockwise (toward an arrow shown in FIG. 2). Around the PC belt 25, there are provided the high-pressure unit 26, the blank lamp 19, the developers 27Y, 27M, 27C and 27B, and the TX belt 28. The high-pressure unit 26 is located in the upstream side of the exposing location P with respect to the direction of the rotation of the PC belt 25 and serves to pre-charge the surface of the PC belt 25. The blank lamp 19 serves to remove unnecessary charges from the surface of the PC belt 25 and form voids when copying an image. The developers 27Y, 27M, 27C and 27B operate to develop the electrostatic latent image on the PC belt 25 by using the toners of yellow (Y), magenta (M), cyan (C) and black (B), respectively. The TX belt 28 is provided for overlapping the toner images of the colors for forming a color image.

In performing a color copying, the light from the copy lump 18 is applied to the original 22 for scanning the image of the original 22 three times. As a result, the light reflected by the original 22 is decomposed into three original colors of red (R), green (G) and blue (B) through the optical filter 23. The electrostatic latent image of each color is formed on the PC belt 25. The three electrostatic latent images on the PC belt 25 are visualized through the effect of the developers 27Y, 27M and 27C. The visualization of the decomposed color image is carried out by the developers 27Y, 27M and 27C, each of which uses the toner of the complementary color to the object color. The visualized color images are overlapped on the TX belt 28.

In performing a monochrome copying, the light from the copy lump 18 is applied to the original 22 for scanning the image of the original one time. As a result, the light reflected by the original 22 is applied to the PC belt 25 at the exposing location P and an electrostatic latent image is formed on the PC belt 25. The formed electrostatic latent image is visualized by the developer 27B using the toner of black (B) and the resulting image is transferred onto the TX belt 28 as a middle stage.

In those normal copying operations, the blank lamp 19 is lit on or off for removing unnecessary charges from the non-copied area of the PC belt 25.

The TX belt 28 is rotated clockwise (toward an arrow shown in FIG. 2). The toner density sensor 17 is located in opposition to the TX belt 28.

A paper on which a copied image is to be formed is conveyed from each of the paper cassettes 29 to a transfer location T of the TX belt 28 at which a color or monochrome toner image is transferred onto the TX belt 28. Then, the toner image is fixed by the fixer 30 and then the image-formed paper is ejected.

The toner density sensor 17 serves to output a voltage in proportional to the toner density of the color image. Since the TX belt 28 has a black surface, the toner density sensor 17 is effective in measuring the toner density of the color image without measuring the toner density of a black image according to the image adjusting apparatus of this embodiment.

In turn, the description will be directed to the arrangement of an operation panel included in the color copying machine.

Figure 3:
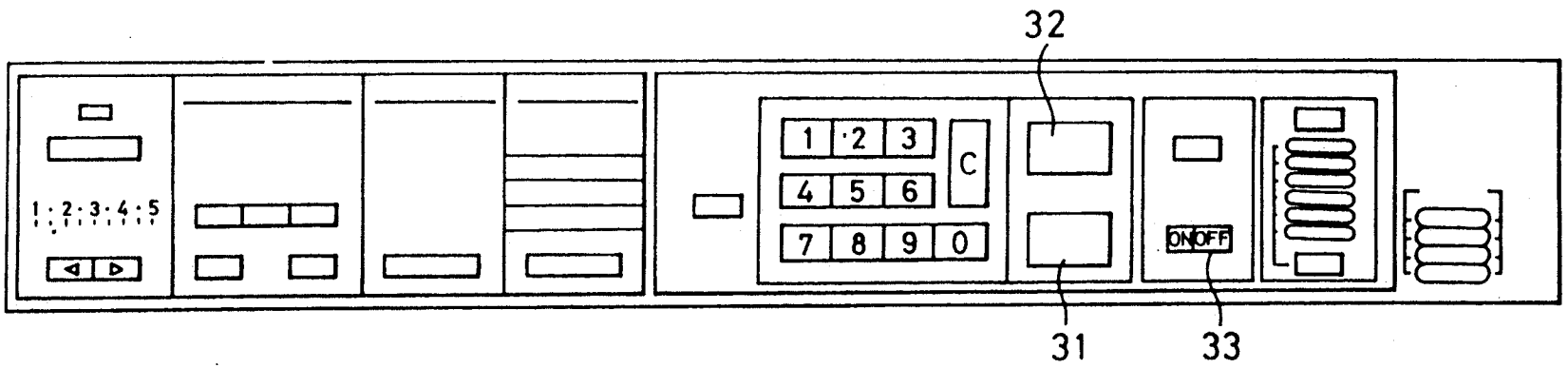
FIG. 3 is a plane view showing an operation panel included in the color copying machine shown in FIG. 2.

FIG. 3 is a plane view showing an operation panel included in the color copying machine shown in FIG. 2.

As shown in FIG. 3, the operation panel provides a color copy button 31 by which the color copy is started, a monochrome copy button 32 by which the monochrome copy is started, and a mode-selecting button 33 for selecting a graphic mode or a photo mode. The graphic mode is selected to enhance the reproducibility of a text document and the photo mode is selected to enhance the reproducibility of a photo document.

This operation panel is connected to the CPU 11 through the I/O device 15 shown in FIG. 1. If the photo mode is selected by the mode-selecting button 33 and then the color copy button 31 is pressed, the CPU 11 operates to start the control of copying at a color photo mode. On the other hand, if the graphic mode is selected and then the color copy button 31 is pressed, the CPU 11 operates to start the control of copying at a color graphic mode.

Though not shown, the color copying machine has a switch for setting a mode at which a reference exposing voltage of the copy lamp 18 is calculated.

When the mode for adjusting the reference exposing voltage of the copy lamp 18 is set by that switch and then the photo mode is selected by the mode-selecting button 33, if the color copy button 31 is pressed, the CPU 11 operates to start the control at the mode for calculating a reference voltage for a color photo mode. On the other hand, when the mode for adjusting the reference exposing voltage of the copy lamp 18 is set by that switch and the graphic mode is selected by the mode-selecting button 33, if the color copy button 31 is pressed, the CPU 11 operates to start the control at the mode for calculating a reference voltage for a color graphic mode. The term "reference voltage" means an optimum voltage at which the copy lamp 18 is operated at each of the copying modes.

Figure 4:
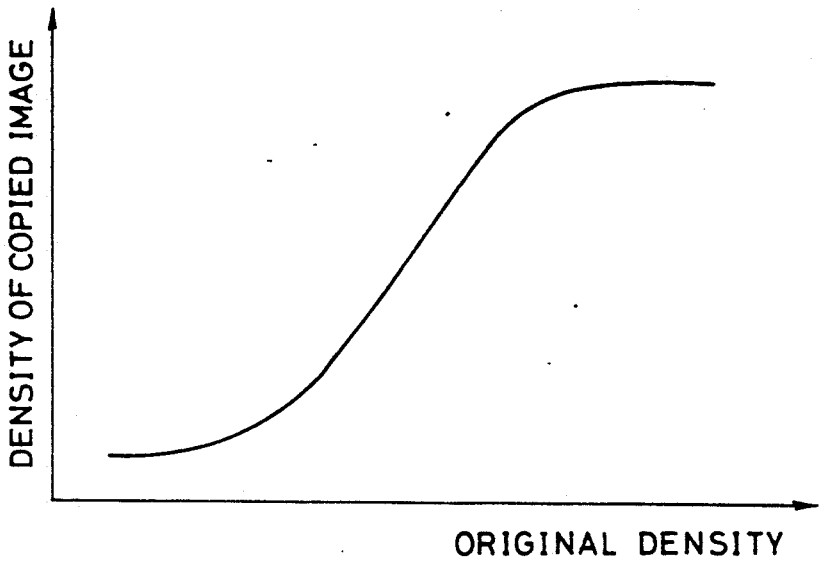
FIG. 4 is a graph showing a relation between a document density and a copied image density at a graphic mode provided in the color copying machine shown in FIG. 2.
Figure 5:
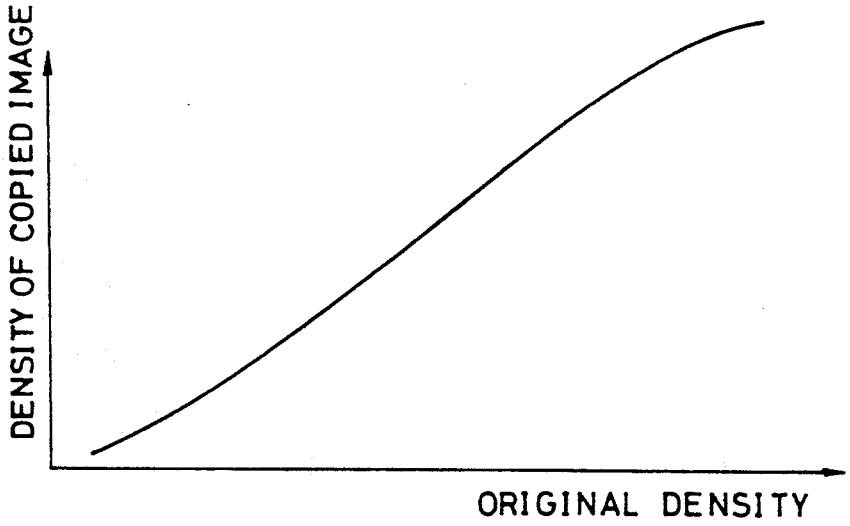
FIG. 5 is a graph showing a relation between a document density and a copied image density at a photo mode provided in the color copying machine shown in FIG. 2.
Figure 6:
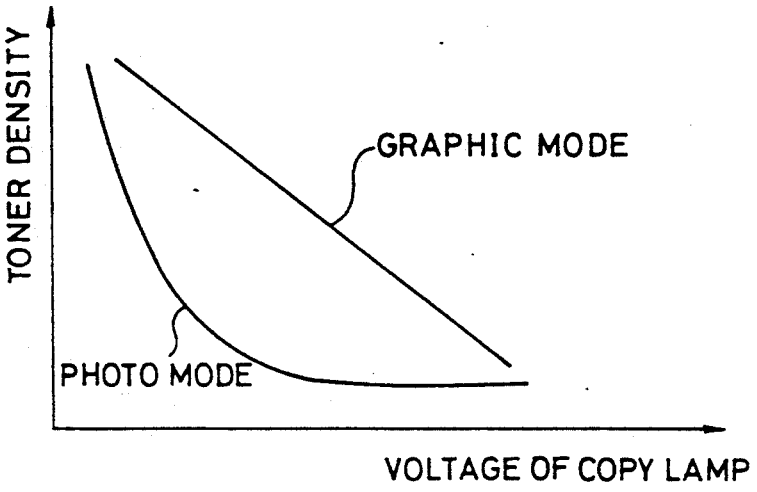
FIG. 6 is a graph showing a relation between a copy lamp voltage and a toner density when an automatic exposure adjustment is executed in the color copying machine shown in FIG. 2.

FIGS. 4 to 6 show characteristics of a toner density at each copying mode provided in the color copying machine shown in FIG. 2, respectively. FIG. 4 shows a relation between an original density and a copied image density at the graphic mode. FIG. 5 shows a relation between the original density and the copied image density at the photo mode, and FIG. 6 shows a relation between a copy lamp voltage and a toner density when the automatic exposure adjustment is executed.

At the graphic mode, as shown in FIG. 4, the toner density is controlled so that the tone of the original density is intensified for enhancing the reproducibility of the text document. At the photo mode, as shown in FIG. 5, the toner density is controlled so that a halftone may be made smoother for enhancing the reproducibility of the photo document. When the automatic exposure adjustment is executed, as shown in FIG. 6, at the graphic mode, the toner density is proportional to an inverse of the voltage of the copy lamp 18 and, at the photo mode, the toner density is reverse proportional to the voltage of the copy lamp 18.

In turn, the description will be directed to the operation of the image adjusting apparatus, in particular, the CPU 11 according to this embodiment.

Figure 7:
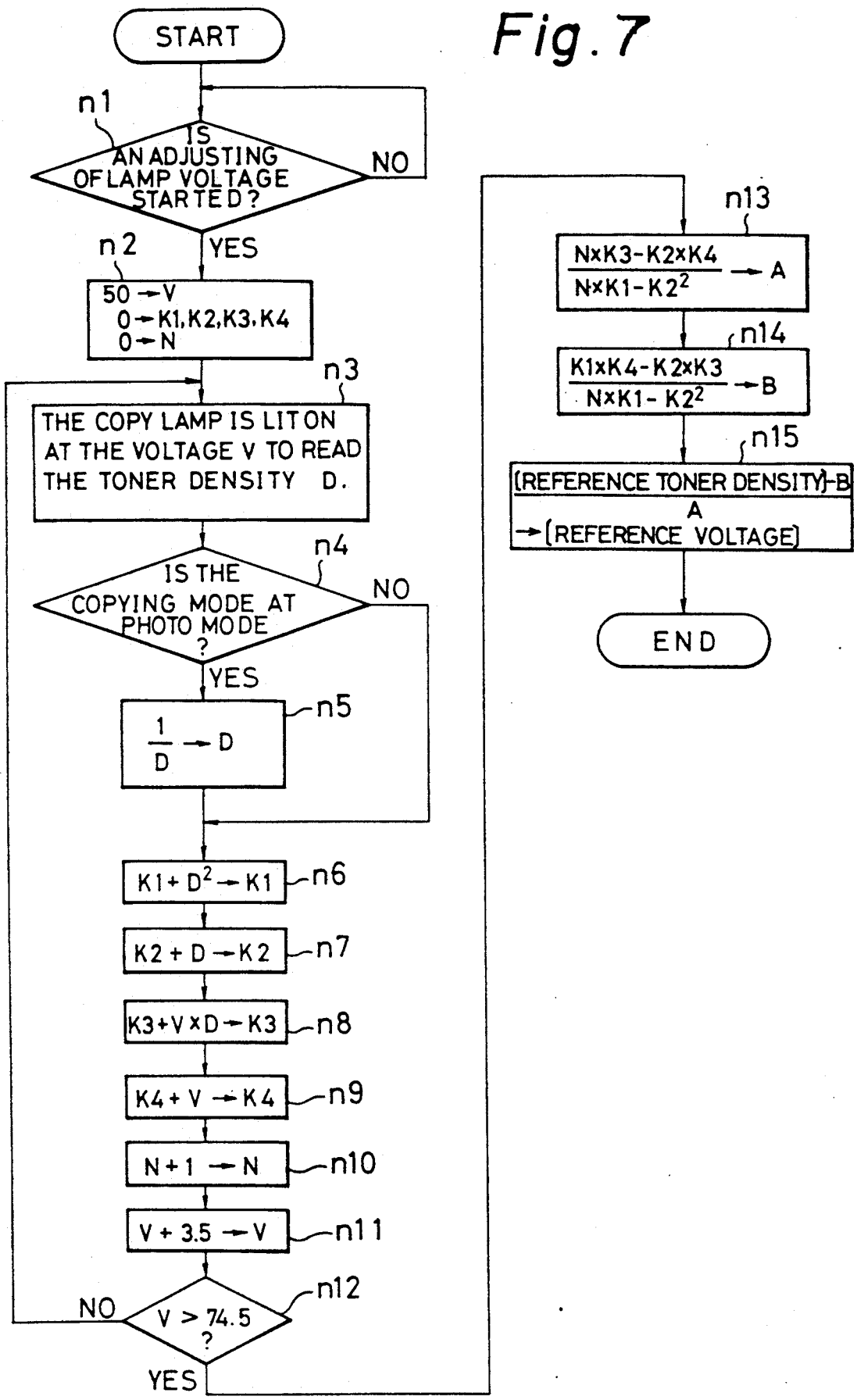
FIG. 7 is a flowchart for explaining an operation of the image adjusting apparatus shown in FIG. 1.

FIG. 7 is a flowchart for explaining the operation of the image adjusting apparatus according to this embodiment.

Assume that on the operation panel (see FIG. 3), the mode for adjusting the reference exposing voltage (lamp voltage adjusting mode) is set, the photo mode or the graphic mode is selected by the mode-selecting button 33, and then the color copy button 31 is pressed (step nl). As the voltage V of the copy lamp 18 is changed from 50 volts to 74.5 volts at each 3.5-volts step, the toner density sensor 17 serves to read the toner density D corresponding to each voltage V of the copy lamp 18 (steps n2 to n12). In this case, a white original is placed on the original platform 21 or a white original cover (not shown) of the original platform 21 is located to be sensed by the toner density sensor 17.

That is, at first, the voltage V of the copy lamp 18 is set as 50 volts. Then, variables K1, K2, K3 and K4 for deriving constants A and B of a function and a counter N for indicating the times of measurement (the number of samples) are reset to zero (step n2).

Next, the copy lamp 18 is lit on at the voltage V and the color copying machine shown in FIG. 2 is started to be driven. Then, the toner density D is read through the toner density sensor 17 (step n3). The toner density D is processed under the following equation (1) if the graphic mode is selected or the following equation (2) if the photo mode is selected.

$$D=A\times X+B \tag{1}$$

$$D=A/X+B \tag{2}$$

wherein A and B are constants.

To obtain these constants by the least square method, a variable X of the following equation (3) is substituted by X=D for obtaining the equation for the graphic mode or by X=1/D for obtaining the equation for the photo mode.

$$Y=A\times X+B \tag{3}$$

Hence, for obtaining the constants A and B, the measured toner density D is directly given to the value X of the equation (3) in the case of the graphic mode and a reverse of the measured toner density D is given to the value X of the equation (3) in the case of the photo mode (steps n4 and n5).

Then, the variable K1 ($=K1+D^2$), the variable K2 ($=K2+D$), the variable K3 ($=K3+V\times D$) and the variable K4 ($=K4+V$) are obtained at the steps n6 to n9, respectively. The count value N of the sample is incremented by one (step n10). The voltage V of the copy lamp 18 is increased by each unit of 3.5 volts (step n11). These steps n3 to n11 are repeated until the voltage V of the copy lamp 18 reaches 74.5 volts (step n12).

By applying the least square method to N samples, the following equation (4) is just needed to be a minimum. Hence, it is possible to derive the equations (7) and (8), respectively, by using the equations (5) and (6).

$$\sum_{i=1}^{N}(Y-A\times X-B)^2 \tag{4}$$

$$(d/dA)\left\{\sum_{i=1}^{N}(Y-A\times X-B)^2\right\}=0 \tag{5}$$

$$(d/dB)\left\{\sum_{i=1}^{N}(Y-A\times X-B)^2\right\}=0 \tag{6}$$

$$(d/dA)\left\{\sum_{i=1}^{N}(Y^2+A^2\times X^2+B^2-2\times A\times X\times Y+2\times A\times B\times X-2\times B\times Y)\right\}= \tag{7}$$

$$2\times A\times\sum_{i=1}^{N}X^2-2\times\sum_{i=1}^{N}(X\times Y)+2\times B\times\sum_{i=1}^{N}X$$

-continued $$(d/dB)\left\{\sum_{i=1}^{N}(Y^2+A^2\times X^2+B^2-2\times A\times X\times Y+2\times A\times B\times X-2\times B\times Y)\right\}= \tag{8}$$

$$2\times N\times B+2\times A\times\sum_{i=1}^{N}X-2\times\sum_{i=1}^{N}Y$$

By replacing the variables K1 to K4 with the following equations (9), the equation (10) can be derived by using the equation (7) and the equation (11) can be derived by using the equation (8).

$$K1=\sum_{i=1}^{N}X^2,\ K2=\sum_{i=1}^{N}X,\ K3=\sum_{i=1}^{N}(X\times Y) \tag{9}$$

$$K4=\sum_{i=1}^{N}Y$$

$$A\times K1+B\times K2-K3=0 \tag{10}$$

$$A\times K2+B\times N-K4=0 \tag{11}$$

By solving these equations (10) and (11), therefore, the constants A and B can be derived as follows (steps n13 and n14).

$$A=(N\times K3-K2\times K4)/(N\times K1-K2^2)$$

$$B=(K1\times K4-K2\times K3)/(N\times K1-K2^2)$$

Through the effect of the equation (1), the voltage $V=(D-B)/A$ of the copy lamp 18 is stored as a reference voltage in the RAM 13.

According to this embodiment, as set forth above, it is possible to set the reference voltage of the copy lamp 18 through the effect of the function corresponding to the graphic mode or the photo mode. This results in being able to automatically and accurately adjust the toner density of the copied image for each of the copying modes, the graphic mode at which the tone of the original density is intensified for enhancing the reproducibility of the text document or the photo mode at which the halftone of the density is made smoother for enhancing the reproducibility of the photo document.

Further, as mentioned above, the apparatus of this embodiment uses the least square method based on the measured points (sample data) for obtaining the optimum lamp voltage. If one sample has a too much dispersion, therefore, the apparatus is difficult to suffer from the dispersion of the one sample when setting the reference voltage, unlike the apparatus known by the present inventors which is arranged to use a polygonal linear function approximating to the relation between the exposing voltage and the toner density. The image adjusting apparatus of this embodiment enables to keep the automatic adjusting accuracy of the toner density of the copied image independently of the characteristics of the toner density against the voltage.

In turn, the description will be directed to an embodiment of an image adjusting apparatus according to a second aspect of the present invention.

The arrangement of this image adjusting apparatus is the same as that of the embodiment of the image adjusting apparatus according to the first aspect of the present invention shown in FIG. 1. The embodiment of the image adjusting apparatus according to the first aspect of the present invention is arranged to derive a reference voltage of the copy lamp 18 through the effect of the functions corresponding to the copying modes. On the other hand, an embodiment of the image adjusting apparatus according to the second aspect of the present invention is arranged to derive a reference voltage of the copy lamp 18 based on a function having the same functional type of the second or more order for both of the graphic mode and the photo mode. By changing the program stored in the ROM 12 shown in FIG. 1, it is possible to arrange the image adjusting apparatus of this embodiment.

Figure 8:
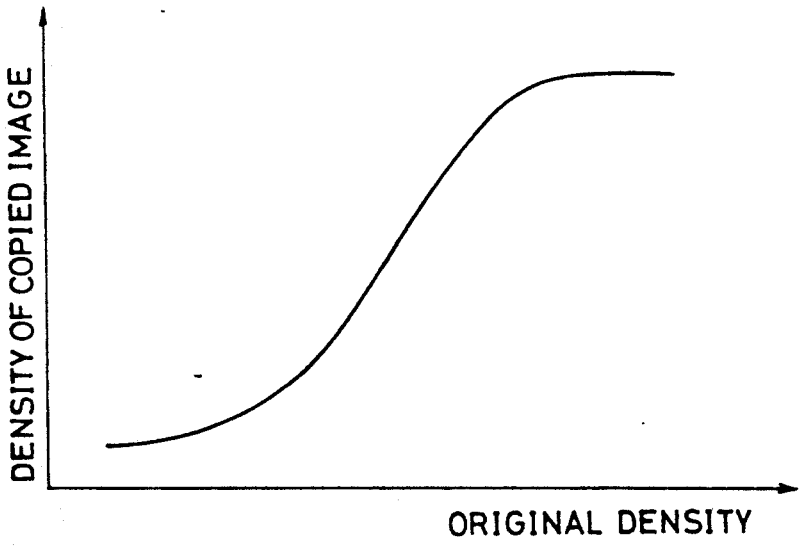
FIG. 8 is a graph showing a relation between a document density and a copied image density at a graphic mode provided in a color copying machine having an image adjusting apparatus according to a second aspect of the present invention.
Figure 9:
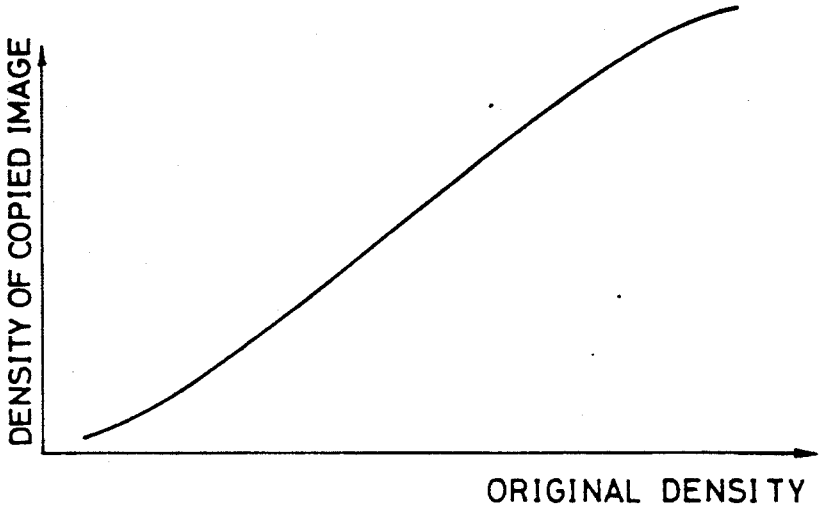
FIG. 9 is a graph showing a relation between a document density and a copied image density at a photo mode provided in the color copying machine having the image adjusting apparatus according to the second aspect of the present invention.
Figure 10:
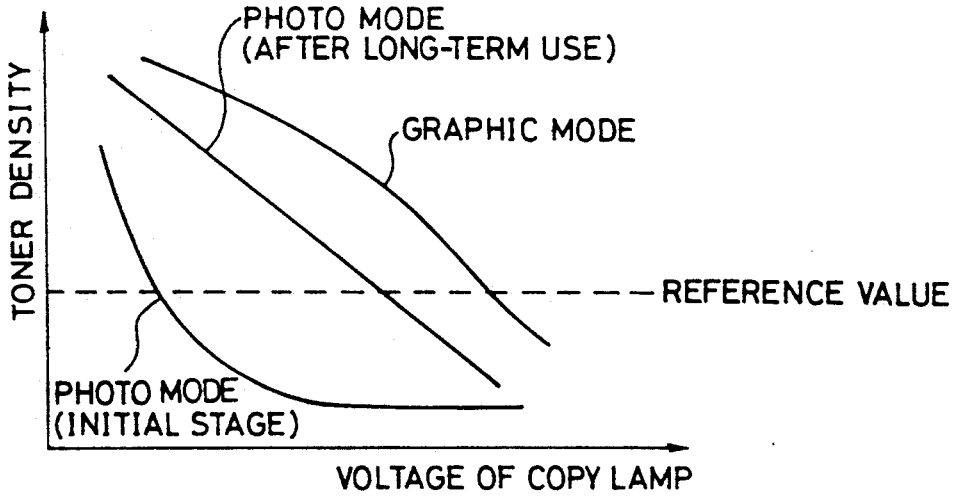
FIG. 10 is a graph showing a relation between a copy lamp voltage and a toner density when an automatic exposure adjustment is carried out in the color copying machine having the image adjusting apparatus according to the second aspect of the present invention.

FIGS. 8 to 10 show the characteristics of the toner density at the copying modes provided in the color copying machine having the image adjusting apparatus according to the second aspect of the present invention, respectively. FIG. 8 shows a relation between an original density and an copied image density at the graphic mode. FIG. 9 shows a relation between an original density and an copied image density at the photo mode. FIG. 10 shows a relation between a copy lamp voltage and a toner density when an automatic exposure adjustment is carried out.

At the graphic mode, as shown in FIG. 8, the toner density is controlled so that the tone of the original density is intensified for enhancing the reproducibility of the text document. At the photo mode, as shown in FIG. 9, the toner density is controlled so that the halftone of the density is made smoother for enhancing the reproducibility of the photo document. Further, as shown in FIG. 10, at the photo mode, when a white original is used, the characteristics of the toner density against the voltage of the copy lamp 18 may change on time, that is, at the initial stage and after a long-term use.

Next, the description will be directed to the operation of the image adjusting apparatus according to this embodiment, in particular, the operation of the CPU 11.

At first, the voltage V of the copy lamp 18 is changed at each unit of 3.5 volts from 50 volts to 74.5 volts. The toner density D at each 3.5-volts is sensed by the toner density sensor 17. The constants a, b and c of the function of the second order represented by the following equation (12) are defined at each of the copying modes and with a change on standing. Then, the voltage of the copy lamp 18 can be obtained from the cross point between a predetermined reference toner density and the function of the second order defined by the constants a, b and c. When the actual copying is carried out, a reference voltage can be derived so that the obtained voltage may be applied to the copy lamp 18.

$$D = aV^2 + bV + c \tag{12}$$

By using the function of the second order shown in the equation (12) for the least square method, the following equation (13) is just needed to be the least. For the purpose, therefore, it is possible to merely establish the equations (14), (15) and (16).

$$\sum_{i=1}^{N} (aVi^2 + bVi + c - Di)^2 \tag{13}$$

$$(d/da) \sum_{i=1}^{N} (aVi^2 + bVi + c - Di)^2 = 0 \tag{14}$$

$$(d/db) \sum_{i=1}^{N} (aVi^2 + bVi + c - Di)^2 = 0 \tag{15}$$

$$(d/dc) \sum_{i=1}^{N} (aVi^2 + bVi + c - Di)^2 = 0 \tag{16}$$

From those equations (14), (15) and (16), it is possible to obtain the following equations (17), (18) and (19), respectively.

$$2 \times \sum_{i=1}^{N} (Vi^2) \cdot (aVi^2 + bVi + c - Di) = 0 \tag{17}$$

$$2 \times \sum_{i=1}^{N} Vi \cdot (aVi^2 + bVi + c - Di) = 0 \tag{18}$$

$$2 \times \sum_{i=1}^{N} (aVi^2 + bVi + c - Di) = 0 \tag{19}$$

The value of k1 to k8 represented in the following equation (20) are applied to those equations (17), (18) and (19), resulting in establishing the equations (21), (22) and (23), respectively.

$$K1 = \sum_{i=1}^{N} Vi^4,\ K2 = \sum_{i=1}^{N} Vi^3,\ K3 = \sum_{i=1}^{N} Vi^2,\ K4 = \sum_{i=1}^{N} Vi \tag{20}$$

$$K5 = \sum_{i=1}^{N} 1,\ K6 = \sum_{i=1}^{N} Di \cdot Vi^2,\ K7 = \sum_{i=1}^{N} Di \cdot Vi,$$

$$K8 = \sum_{i=1}^{N} Di$$

$$a \cdot k1 + b \cdot k2 + c \cdot k3 - k6 = 0 \tag{21}$$
$$a \cdot k2 + b \cdot k3 + c \cdot k4 - k7 = 0 \tag{22}$$
$$a \cdot k3 + b \cdot k4 + c \cdot k5 - k8 = 0 \tag{23}$$

Those equations (21), (22) and (23) are represented by the following matrix equation (24).

$$\begin{pmatrix} k1 & k2 & k3 \\ k2 & k3 & k4 \\ k3 & k4 & k5 \end{pmatrix} \begin{pmatrix} a \\ b \\ c \end{pmatrix} = \begin{pmatrix} k6 \\ k7 \\ k8 \end{pmatrix} \tag{24}$$

Hence, by using the following matrix equations (25) and (26), it is possible to derive the constants a, b and c.

$$\begin{pmatrix} a \\ b \\ c \end{pmatrix} = \begin{pmatrix} k1 & k2 & k3 \\ k2 & k3 & k4 \\ k3 & k4 & k5 \end{pmatrix}^{-1} \begin{pmatrix} k6 \\ k7 \\ k8 \end{pmatrix} \tag{25}$$

$$\begin{pmatrix} a \\ b \\ c \end{pmatrix} = (1/A) \times \tag{26}$$

-continued $$\begin{pmatrix} k3 \cdot k5 - k4^2 & k4 \cdot k3 - k2 \cdot k5 & k2 \cdot k4 - k3^2 \\ k3 \cdot k4 - k2 \cdot k5 & k1 \cdot k5 - k3^2 & k2 \cdot k3 - k1 \cdot k4 \\ k2 \cdot k4 - k3^2 & k3 \cdot k2 - k1 \cdot k4 & k1 \cdot k3 - k2^2 \end{pmatrix} \begin{pmatrix} k6 \\ k7 \\ k8 \end{pmatrix}$$

In the matrix equation (26), A is represented by the following equation.

$$A = k1 \cdot k3 \cdot k5 + k2 \cdot k4 \cdot k3 \cdot k3 \cdot k2 \cdot k4 - k1 \cdot k4^2 - k2^2 \cdot k5 - k3^3$$

The image adjustment apparatus according to the second aspect of the present invention is arranged to represent the toner density D by the function of the second order of the voltage V of the copy lamp 18. However, a function of more order may be used without limiting the use of the function of the second order.

Figure 11:
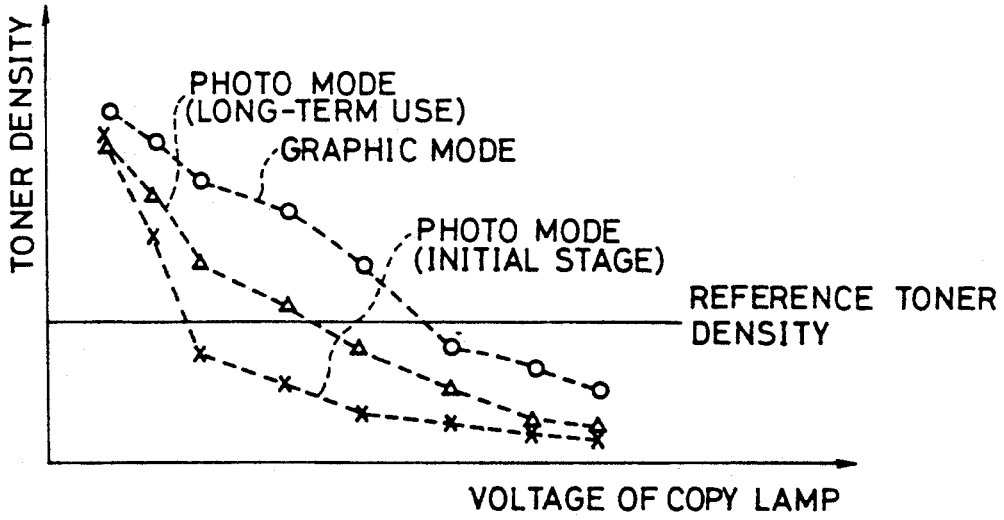
FIG. 11 is a graph showing a polygonal linear function approximating to a relation between a toner density and a voltage of a copy lamp.
Figure 12:
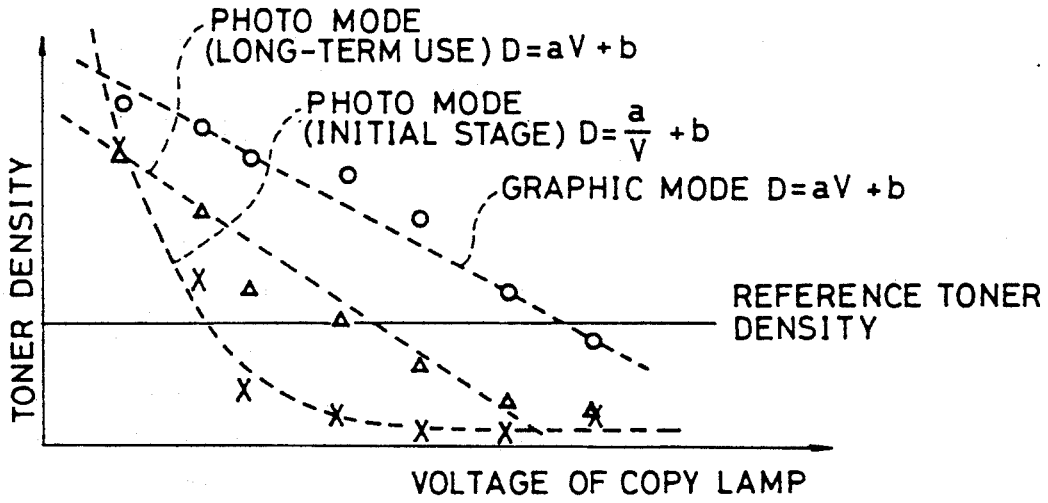
FIG. 12 is a graph showing a function being changed to correspond to a copying mode.
Figure 13:
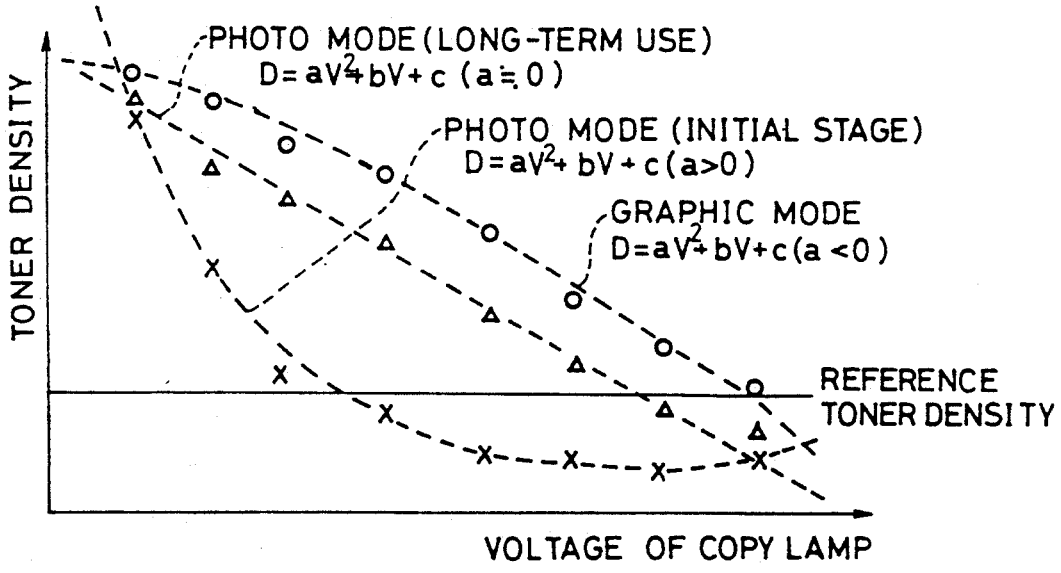
FIG. 13 is a graph showing one function of the second order approximating to a relation between a toner density and a voltage of a copy lamp.

FIGS. 11 to 13 show functions used when setting the reference voltage of the copy lamp 18, respectively. FIG. 11 shows the polygonal linear funetion approximating to the relation between the toner density and the voltage of the copy lamp 18. FIG. 12 shows the function being changed to correspond to the copying mode. FIG. 13 shows one function of the second order approximating to the relation between the toner density and the voltage of the copy lamp 18.

As shown in FIG. 11, an image adjusting apparatus known by the present inventors is arranged to use the polygonal linear function for approximating the measured values and derive the voltage of the copy lamp 18 at a cross point between the measured value and the reference toner density. When the copying is carried out, the reference voltage is adjusted so that the derived voltage at the cross point may be applied to the copy lamp 18.

As shown in FIG. 12, the image adjusting apparatus according to the foregoing embodiment of the first invention is arranged to use the function for each of the copying modes. In this embodiment of the second invention, the same function of the second order as shown in FIG. 13 is used for setting the reference voltage of the copy lamp 18. That is, at the graphic mode shown in FIG. 13, the secondary coefficient 'a' of the function of the second order obtained by the least square method is made negative. At the photo mode in the initial stage, the secondary coefficient 'a' of the function of the second order is made positive. Then, at the photo mode after a long-term use, the secondary coefficient 'a' of the function of the second order is made substantially zero.

If the toner density D is represented by a function of the second order of the voltage V of the copy lamp 18, the two cross points between the function of the second order and the reference toner density can be derived. Usually in the case that the voltage of the copy lamp is in the range from 50 volts to 74.5 volts, the toner density D is monotonically decreased. Hence, the solutions should be selected to correspond to the cross points existing in the range from 50 volts to 74.5 volts of the lamp voltage.

According to this embodiment, therefore, the optimum function is derived independently of the copying modes, that is, the graphic mode at which the tone of the original density is intensified for enhancing the reproducibility of the text document and the photo mode at which the halftone of the density is made smoother for enhancing the reproducibility of the photo document. That is, since the reference voltage of the copy lamp 18 is allowed to be set through the effect of the function having the same functional type of the second or more order for two or more copying modes, it is possible to automatically and accurately adjust the toner density of the copied image for two or more copying modes.

Since the optimum voltage is obtained from the measured points (samples) by the least square method, if one of the samples has a far dispersion, the image adjusting apparatus of this embodiment is difficult to suffer from the condition when setting a proper reference voltage, unlike the apparatus known by the present inventors which is arranged to approximate the relation between the exposing voltage and the toner density by using the polygonal linear function. It means that the reference voltage is independent of the characteristic of the toner density against the voltage, resulting in keeping the automatic adjusting accuracy of the toner density of the copied image. In addition, since the reference voltage is set by the same functional type, the overall apparatus can be simplified in arrangement and reduced in size.

In the above description, the graphic mode and the photo mode have been employed as two or more copying modes. The copying modes are not limited to these two modes. Further, in the foregoing embodiments, the toner density has been measured on the TX belt 28. In place, the toner density may be inferred from the voltage applied on the PC belt 25. Further, in place of adjusting the exposing voltage of the copy lamp 18, the apparatus may be arranged to adjust the charging voltage of the high-pressure unit 26 and the bias voltages of the developers 27Y, 27M and 27C.

Many widely different embodiments of the present invention may be constructed without departing from the spirit and scope of the present invention. It should be understood that the present invention is not limited to the specific embodiments described in the specification, except as defined in the appended claims.

What is claimed is:

1. An image adjusting apparatus being provided in a copying machine capable of performing a copy of an original by using a photosensitive body in two or more copying modes, comprising:

a light source for lighting the original;

means for sensing a toner density of an image formed on said photosensitive body;

means for deriving a function in accordance with each of the two or more copying modes if a control voltage influencing the toner density applied to said light source is changed, said function standing for a relation between the changed control voltage applied to said light source and the toner density sensed by said sensing means; and means for setting the control voltage applied to said light source to be a voltage value obtained based on a predetermined reference toner density and the function derived by said deriving means.

2. An image adjusting apparatus according to claim 1, wherein said sensing means includes a toner density sensor.

3. An image adjusting apparatus according to claim 1, wherein said deriving means and said setting means includes a CPU.

4. An image adjusting apparatus being provided in a copying machine capable of performing a copy of an original by using a photosensitive body in two or more copying modes, comprising: means for sensing a toner density of an image formed on said photosensitive body;

means for deriving a function of the second or more order as the same functional type independently of the two or more copying modes if a control voltage influencing the toner density is changed, said function standing for a relation between the changed control voltage and the toner density sensed by said sensing means; and means for setting the control voltage to be a voltage value obtained based on a predetermined reference toner density and the function derived by said deriving means.

5. An image adjusting apparatus according to claim 4, wherein said means for sensing the toner density of the image formed on said photosensitive body includes a toner density sensor.

6. An image adjusting apparatus according to claim 4, wherein said means for deriving the function of the second or more order as the same functional type independently of the two or more copying modes and said means for setting the control voltage to be the voltage value includes a CPU.

7. An image adjusting apparatus according to claim 4, wherein said copying machine includes a light source for lighting the original, said means for deriving a function of the second or more order as the same functional type independently of the two or more copying modes includes means for deriving a function the second or more order as the same functional type independently of the two or more copying modes if a voltage applied to said light source is changed, said function standing for a relation between the changed voltage applied to said light source and the toner density sensed by said sensing means, and said means for setting the control voltage to be the voltage value includes means for setting the voltage applied to said light source to be a voltage value obtained based on a predetermined reference toner density and the function derived by said deriving means.

* * * * *